US010781543B2

(12) United States Patent
Dominguez

(10) Patent No.: US 10,781,543 B2
(45) Date of Patent: Sep. 22, 2020

(54) GUIDE TOOLING FOR A CIRCULAR NEEDLING TABLE FOR NEEDLING A TEXTILE STRUCTURE MADE FROM A HELICAL FIBER SHEET

(71) Applicant: SAFRAN LANDING SYSTEMS, Velizy-Villacoublay (FR)

(72) Inventor: Laurent Dominguez, Ternay (FR)

(73) Assignee: SAFRAN LANDING SYSTEMS, Velizy-Villacoublay (FR)

( * ) Notice: Subject to any disclaimer, the term of this patent is extended or adjusted under 35 U.S.C. 154(b) by 57 days.

(21) Appl. No.: 16/110,152

(22) Filed: Aug. 23, 2018

(65) Prior Publication Data

US 2019/0071805 A1 Mar. 7, 2019

(51) Int. Cl.
*D04H 18/02* (2012.01)

(52) U.S. Cl.
CPC ..... *D04H 18/02* (2013.01)

(58) Field of Classification Search
CPC ..... D04H 18/02; D04H 1/46; D04H 3/105; D04H 3/102; D04H 5/02; D04H 13/005; D04H 1/4242; D04H 1/498; D04H 18/00; D03D 37/00; D04B 9/00; D04B 9/20; D05C 1/04; D10B 2505/02
USPC ..... 28/107–115; 38/102.4
See application file for complete search history.

(56) References Cited

U.S. PATENT DOCUMENTS 17,353 A * 5/1857 Carney ..... D03D 37/00 139/457
189,353 A * 4/1877 Gillespie ..... D03D 37/00 139/459
1,822,292 A * 9/1931 Jabouley ..... D03D 37/00 139/457
3,105,523 A * 10/1963 Borrell ..... D03D 37/00 139/457
4,642,924 A * 2/1987 Sudderth ..... D05C 1/04 112/103

(Continued)

FOREIGN PATENT DOCUMENTS

EP 2 339 055 A1 6/2011
EP 2 341 175 A1 7/2011
EP 2 947 191 A1 11/2015

OTHER PUBLICATIONS

French Preliminary Search Report dated Mar. 26, 2018 in French Application 17 58084 filed on Sep. 1, 2017 (with English Translation of Categories of Cited Documents).

*Primary Examiner* — Amy Vanatta
(74) *Attorney, Agent, or Firm* — Oblon, McClelland, Maier & Neustadt, L.L.P.

(57) ABSTRACT

The invention relates to guide tooling (22) for a circular needling table for needling a textile structure made from a helical fiber sheet, the tooling comprising an inner guide rail (24) of circularly arcuate shape, and an outer guide rail (26) of circularly arcuate shape arranged coaxially around the inner guide rail and connected thereto by radial reinforcement (28), the outer and inner guide rails defining between them a passage for guiding the helical fiber sheet under a needling head, the outer guide rail being made up of two outer guide rail angular sectors (26*a*, 26*b*) that are connected to each other by an outer actuator (28), the outer actuator being suitable for moving the adjacent free ends (26*a*-1, 26*b*-1) of the outer guide rail angular sectors apart from each other so as to expand the outer guide rail.

9 Claims, 2 Drawing Sheets

(56) References Cited

U.S. PATENT DOCUMENTS

| | | | | |
|---|---|---|---|---|
| 5,409,044 | A * | 4/1995 | Lin | D03D 37/00 139/457 |
| 6,363,593 | B1 * | 4/2002 | Duval | D04H 18/00 28/107 |
| 7,185,404 | B2 * | 3/2007 | Delecroix | D04H 1/498 28/101 |
| 9,303,343 | B2 * | 4/2016 | Gautier | D04H 1/4242 |
| 9,340,913 | B1 * | 5/2016 | Gala | D05C 1/04 |
| 2004/0040186 | A1 * | 3/2004 | Wilson | D05C 1/04 38/102.2 |
| 2007/0090564 | A1 * | 4/2007 | Delecroix | B32B 37/00 264/258 |
| 2011/0154628 | A1 | 6/2011 | Vincent et al. | |
| 2011/0154629 | A1 | 6/2011 | Delecroix | |
| 2015/0337468 | A1 | 11/2015 | La Costaouec | |
| 2017/0292211 | A1 | 10/2017 | La Costaouec | |

* cited by examiner

GUIDE TOOLING FOR A CIRCULAR NEEDLING TABLE FOR NEEDLING A TEXTILE STRUCTURE MADE FROM A HELICAL FIBER SHEET

BACKGROUND OF THE INVENTION

The present invention relates to the general field of circular needling tables for making needled textile structures from a helical fiber sheet.

It is known to use a needling table of circular type for fabricating annular textile structures that are to constitute the fiber reinforcement of annular parts made out of composite material, in particular brake disks, such as carbon/carbon (C/C) composite material disks for airplane brakes.

A circular needling table generally comprises a horizontal annular turntable on which a helical fiber sheet is placed, drive means (usually friction drive means) for driving the fiber sheet in rotation about the vertical axis of the turntable, and a needling device having a needling head extending over an angular sector of the turntable and driven to move vertically relative to the turntable. Reference may be made to Document WO 02/088451, which describes an embodiment of such a needling table.

Also known from Document EP 2 339 055 is a needling machine in which the needling table includes guide tooling in the form of two annular walls centered on the vertical axis of the turntable and connected together by lateral reinforcement serving to provide lateral guidance for the fiber sheet during its rotation about the vertical axis.

With that type of needling table, once the structure has been needled, it is necessary to take hold of it and remove it from the table without damaging it, in particular by exerting mechanical stresses. Unfortunately, the presence of walls for guiding the sheet makes that operation difficult to perform without damaging the fiber structure.

OBJECT AND SUMMARY OF THE INVENTION

A main object of the present invention is thus to propose guide tooling that does not present the above-mentioned drawbacks and that enables the needled structure to be removed without exerting mechanical stresses.

This object is achieved by guide tooling for a circular needling table for needling a textile structure made from a helical fiber sheet, the tooling comprising an inner guide rail of circularly arcuate shape, and an outer guide rail of circularly arcuate shape arranged coaxially around the inner guide rail and connected thereto by radial reinforcement, the outer and inner guide rails defining between them a passage for guiding the helical fiber sheet under a needling head, and wherein, in accordance with the invention, the outer guide rail is made up of two outer guide rail angular sectors that are connected to each other by an outer actuator, the outer actuator being suitable for moving the adjacent free ends of the outer guide rail angular sectors apart from each other so as to expand the outer guide rail.

The guide tooling of the invention is remarkable in that it is possible to expand the outer guide rail once the structure has been made, thereby making it easier to extract the structure from the guide tooling without exerting mechanical stress thereon, and thus without risk of damaging it. Naturally, during the stage of needling proper, the outer guide rail is maintained in its contracted position by the outer actuator.

The outer actuator may comprise an actuator cylinder fastened to a free end of one of the two outer guide rail angular sectors, and a rod fastened to an adjacent free end of the other outer guide rail angular sector, the outer actuator being positioned outside the outer guide rail and extending in a direction that is tangential thereto.

Furthermore, the outer guide rail may expand by pivoting of the two outer guide rail angular sectors about distant free ends of said outer guide rail angular sectors.

In an advantageous provision, the inner guide rail is made up of two inner guide rail angular sectors that are connected together by an inner actuator, the inner actuator being suitable for moving the distant free ends of the inner guide rail angular sectors towards each other so as to contract the inner guide rail.

Contracting the inner guide rail further facilitates extracting the finished needled structure from the guide tooling, thereby further reducing any risk of damaging it.

Under such circumstances, the inner actuator may comprise an actuator cylinder fastened to one of the two inner guide rail angular sectors, and a rod fastened to the other inner guide rail angular sector, the inner actuator being positioned inside the inner guide rail and extending along a direction tangential thereto.

Furthermore, the inner guide rail may be contracted by pivoting the two inner guide rail angular sectors about adjacent free ends of said inner guide rail angular sectors.

The radial reinforcement may be secured to a plate positioned over the inner and outer guide rails. Under such circumstances, the plate advantageously includes a deflector designed to guide the helical fiber sheet from a feed table towards the passage defined between the outer and inner guide rails.

The invention also provides a circular needling table for needling a textile structure made from a helical fiber sheet, the table including guide tooling as defined above.

BRIEF DESCRIPTION OF THE DRAWINGS

Other characteristics and advantages of the present invention appear from the following description made with reference to the accompanying drawings, which show an embodiment having no limiting character. In the figures.

DETAILED DESCRIPTION OF THE INVENTION

Figure 1:
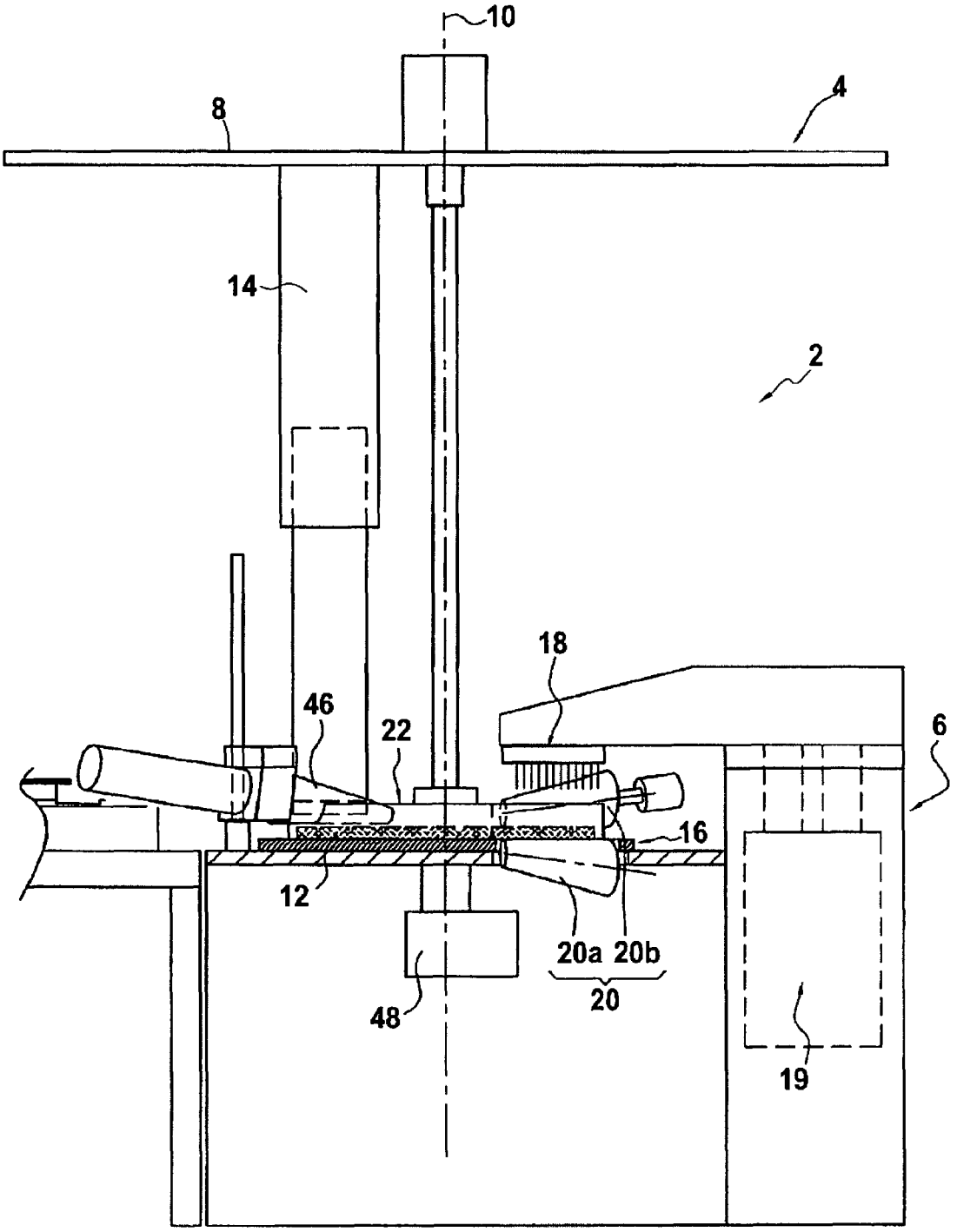
FIG. 1 is a side view showing a needling machine in which the needling table is provided with guide tooling of the invention.

FIG. 1 shows a circular needling machine 2 for needling a textile structure, or annular preform, made from a helical fiber sheet (or strip).

Typically, and as described in publication EP 2 339 055, the needling machine 2 has a feed table 4 for feeding fiber sheets for needling, which feed table is located above a needling table 6.

By way of illustration, the feed table 4 for feeding fiber sheets for needling may comprise a circular conveyor 8 centered on a vertical axis 10 and having a fiber sheet 12 for needling placed thereon. More precisely, the fiber sheet may be wound as a plurality of turns about the vertical axis 10 and may be driven in rotation about the vertical axis by the circular conveyor 8.

Under the circular conveyor 8, the feed table 4 leads to a straight chute 14 that extends vertically between the circular conveyor and the needling table 6. The function of this chute is to take up the sheet 12 as it is unwound from the conveyor and to guide it vertically towards the needling table.

The fiber sheet is taken onto a support platform 16 of the needling table 6 and is driven in rotation about the vertical axis 10 in the same direction of rotation as the circular conveyor so as to pass under a needling head 18, which head is driven with vertical reciprocating motion by conventional drive means 19.

For this purpose, the rotary drive means for the fiber sheet may comprise a plurality of pairs of rollers 20 that are angularly spaced apart from one another. Each pair of rollers 20 typically comprises a conical roller 20*a* forming a presser roller in continuous contact with the fiber sheet, and a conical backing roller 20*b* arranged in an opening in the support platform of the needling table and facing the presser roller 20*a* so as to sandwich the fiber sheet between the rollers. More precisely, the support platform 16 is slotted so that the backing rollers come directly into contact with the fiber sheet placed on the platform.

The needling table 6 also has guide tooling 22 pressing on the support platform 16. This guide tooling serves to guide the fiber sheet while it is being needled.

Figure 2:
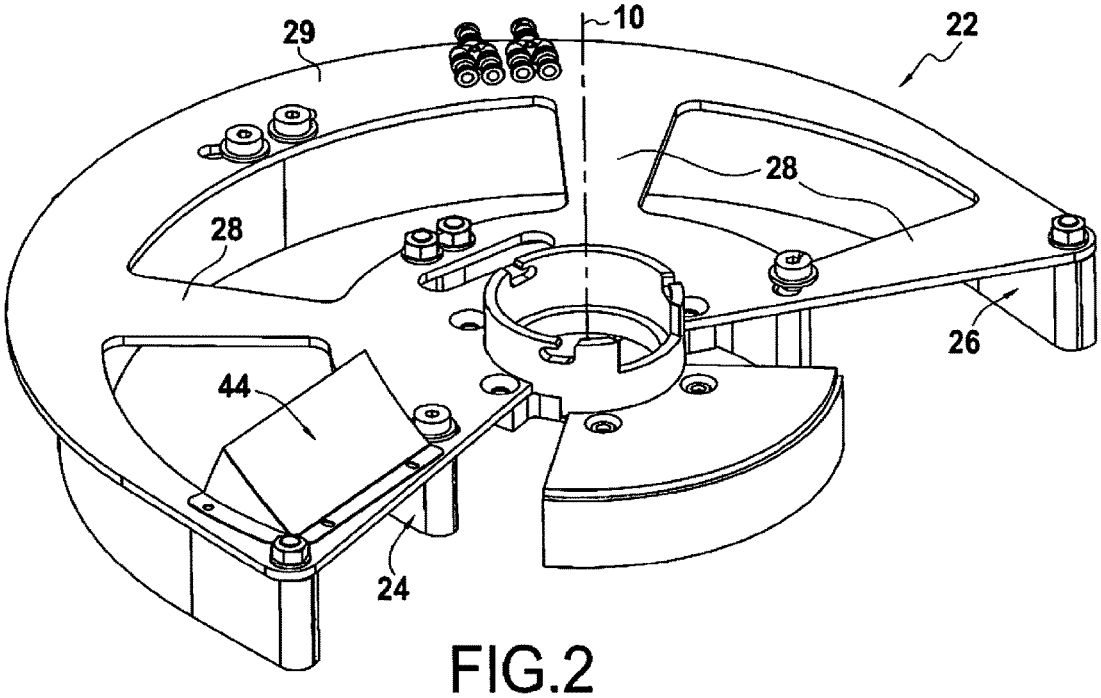
FIGS. 2 and 3 are perspective views, respectively from above and from below, of the FIG. 1 guide tooling.
Figure 3:
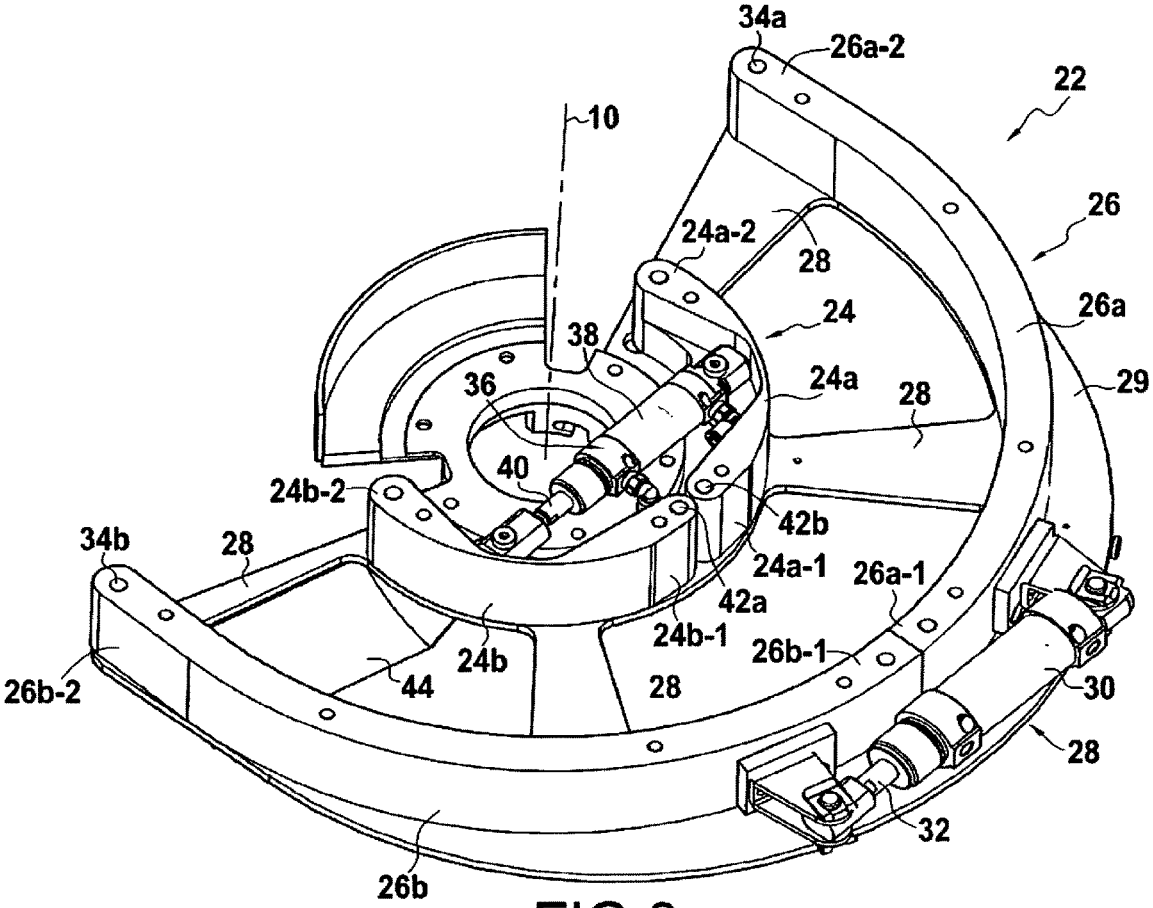

For this purpose, in the invention and as shown in FIGS. 2 and 3, the guide tooling 22 comprises an inner guide rail 24 in the form of a circular arc centered on the vertical axis 10, and an outer guide rail 26 in the form of a circular arc arranged coaxially around the inner guide rail.

The inner and outer guide rails are connected to each other by radial reinforcement 28, thereby defining a passage for guiding the helical sheet under the needling head of the needling table. The radial reinforcement 28 is secured to a plate 29 positioned above the inner and outer guide rails.

Still in the invention, the outer guide rail 26 is made up of two outer guide rail angular sectors 26*a*, 26*b*, which are connected to each other by an outer actuator 28 positioned outside the outer guide rail and extending in a direction that is tangential thereto.

This outer actuator 28 is suitable for moving the adjacent free ends 26*a*-1 and 26*b*-1 of the two outer guide rail angular sectors 26*a* and 26*b* apart from each other so as to expand the outer guide rail.

More precisely, the outer actuator 28 has an actuator cylinder 30 that is fastened to one free end 26*a*-1 of one of the two outer guide rail angular sectors (specifically the outer guide rail sector 26*a* in FIGS. 2 and 3), and a rod 22 that is fastened to an adjacent free end 26*b*-1 of the other outer guide rail angular sector 26*b*.

Thus, when the outer actuator is actuated, its rod 32 extends from the actuator cylinder 30 so as to move apart the adjacent free ends 26*a*-1 and 26*b*-1 of the two outer guide rail angular sectors 26*a* and 26*b*. The distant free ends 26*a*-2 and 26*b*-2 of the outer guide rail sectors pivot about respective stationary pivots 34*a* and 34*b*.

Once needling has terminated, expanding the outer guide rail serves to facilitate extracting the needled fiber structure from the guide tooling 22 without exerting mechanical stress thereon, and thus without risk of damaging it.

The inner guide rail 24 is also made up of two inner guide rail angular sectors 24*a* and 24*b*, which sectors are connected together by an inner actuator 36 positioned inside the inner guide rail and extending in a direction that is tangential thereto.

This inner actuator 36 is suitable for moving towards each other the distant free ends 24*a*-2, 24*b*-2 of the two inner guide rail angular sectors 24*a* and 24*b* so as to contract the inner guide rail.

More precisely, the inner actuator 26 comprises an actuator cylinder 38 that is fastened to one of the two inner guide rail angular sectors (specifically the sector 24*b* of the inner guide rail in FIGS. 2 and 3), and a rod 40 that is fastened to the other inner guide rail angular sector 24*b*.

Thus, when the inner actuator is actuated, its rod 40 enters into the actuator cylinder 38 so as to move the distant free ends 24*a*-2 and 24*b*-2 of the inner guide rail angular sectors towards each other so as to contract the inner guide rail. The adjacent free ends 24*a*-1 and 24*b*-1 of the inner guide rail angular sectors pivot about respective stationary pivots 42*a*, 42*b*.

Once needling has terminated, contracting the inner guide rail 24 serves likewise to facilitate extracting the needled fiber structure from the guide tooling without exerting mechanical stress thereon, and thus without risk of damaging it. By expanding the outside diameter and contracting the inside diameter of the guide tooling, extraction of the needled fiber structure is made considerably easier.

In an advantageous arrangement, the plate 29 to which the radial reinforcement 28 of the guide tooling 22 is secured includes a deflector 44 for guiding the fiber sheet from the outlet of the chute 14 (FIG. 1) towards the passage defined by the outer and inner guide rails of the guide platform.

It should be observed that the needling table also includes a conical roller 46 that is arranged at the outlet from the chute 14 in association with the deflector 44. More precisely, this roller is positioned immediately above the fiber sheet as it leaves the chute in such a manner as to drive the fiber sheet before it passes under the needling head.

It should also be observed that the support platform 16 on which the guide tooling 22 rests is movable vertically under drive from motion-transmission means 48 progressively while the needling operation is taking place.

It should also be observed that the inner and outer actuators used for expanding the outside diameter and contracting the inside diameter of the guide platform may be actuators of any type (pneumatic, electrical, hydraulic, mechanical, manual, etc.).

The invention claimed is:

1. Guide tooling for a circular needling table for needling a textile structure made from a helical fiber sheet, the tooling comprising:

an inner guide rail of circularly arcuate shape; and an outer guide rail of circularly arcuate shape arranged coaxially around the inner guide rail and connected thereto by radial reinforcement, the outer and inner guide rails defining between them a passage for guiding the helical fiber sheet under a needling head;

the tooling being characterized in that the outer guide rail is made up of two outer guide rail angular sectors that are connected to each other by an outer actuator, the outer actuator moving adjacent free ends of the outer guide rail angular sectors apart from each other so as to expand the outer guide rail.

2. Tooling according to claim 1, wherein the outer actuator comprises an actuator cylinder fastened to a free end of one of the two outer guide rail angular sectors, and a rod fastened to an adjacent free end of the other outer guide rail angular sector, the outer actuator being positioned outside the outer guide rail and extending in a direction that is tangential thereto.

3. Tooling according to claim 1, wherein the outer guide rail expands by pivoting of the two outer guide rail angular sectors about distant free ends (26*a*-2, 26*b*-2) of said outer guide rail angular sectors.

4. Tooling according to claim 1, wherein the inner guide rail is made up of two inner guide rail angular sectors that are connected together by an inner actuator, the inner actuator moving distant free ends of the inner guide rail angular sectors towards each other so as to contract the inner guide rail.

5. Tooling according to claim 4, wherein the inner actuator comprises an actuator cylinder fastened to one of the two inner guide rail angular sectors, and a rod fastened to the other inner guide rail angular sector, the inner actuator being positioned inside the inner guide rail and extending along a direction tangential thereto.

6. Tooling according to claim 4, wherein the inner guide rail is contracted by pivoting the two inner guide rail angular sectors about adjacent free ends of said inner guide rail angular sectors.

7. Tooling according to claim 1, wherein the radial reinforcement is secured to a plate positioned over the inner and outer guide rails.

8. Tooling according to claim 7, wherein the plate includes a deflector designed to guide the helical fiber sheet from a feed table towards the passage defined between the outer and inner guide rails.

9. A circular needling table for needling a textile structure made from a helical fiber sheet, the table including guide tooling according to claim 1.

* * * * *